US006354402B1

(12) United States Patent
Masino

(10) Patent No.: US 6,354,402 B1
(45) Date of Patent: Mar. 12, 2002

(54) PLANK SECURING SCAFFOLDING ASSEMBLY

(76) Inventor: Michael D. Masino, 3820 Chevy Chase Dr., La Canada, CA (US) 91011

( * ) Notice: Subject to any disclaimer, the term of this patent is extended or adjusted under 35 U.S.C. 154(b) by 0 days.

(21) Appl. No.: 09/595,485

(22) Filed: Jun. 16, 2000

(51) Int. Cl.[7] ..... E04G 1/16
(52) U.S. Cl. ..... 182/222; 182/178.1; 182/223
(58) Field of Search ..... 182/82, 119, 128, 182/132, 178.5, 179.1, 222, 223, 187, 188

(56) References Cited

U.S. PATENT DOCUMENTS

| | | | | | |
|---|---|---|---|---|---|
| 1,737,315 | A | * | 11/1929 | MacDonald | 182/222 X |
| 1,763,766 | A | * | 6/1930 | Erwin | 182/223 |
| 1,801,904 | A | * | 4/1931 | Davidson | 182/222 |
| 2,198,960 | A | * | 4/1940 | Deck | 182/222 |
| 2,751,258 | A | * | 6/1956 | Brattland | 182/222 |
| 2,928,443 | A | * | 3/1960 | Sevachko | 182/222 X |
| 3,305,046 | A | * | 2/1967 | Schar | 182/222 |
| 3,313,375 | A | * | 4/1967 | McMurray | 182/222 |
| 3,870,124 | A | * | 3/1975 | Howard | 182/178 |
| 4,121,690 | A | * | 10/1978 | Rawlings et al. | 182/45 |
| 4,187,929 | A | * | 2/1980 | Cyr | 182/222 |
| 4,340,130 | A | * | 7/1982 | Payne et al. | 182/179 |
| 5,000,290 | A | * | 3/1991 | Seely | 182/222 |
| 5,918,700 | A | * | 7/1999 | Gregory | 182/186.8 |
| 6,000,495 | A | * | 12/1999 | Brinegar | 182/222 X |

FOREIGN PATENT DOCUMENTS

| | | | | |
|---|---|---|---|---|
| FR | 298886 | * | 1/1989 | 182/222 |
| GB | 2070185 | * | 9/1981 | 182/222 X |

* cited by examiner

*Primary Examiner*—Bruce A. Lev
(74) *Attorney, Agent, or Firm*—Oppenheimer, Wolff & Donnelly, LLP

(57) ABSTRACT

Platform assemblies may be built up using a substantial number of inverted U-shaped vertical supports with platform hold down members that hold the platforms in place, thus avoiding slippage or pilferage. The hold down members form a unitary structure with the supports and platform assemblies to hold the platforms securely in place. The unitary structure of the scaffolding assembly with hold down members acts as a deterrent against pilferage of the platforms because the unitary structure does not allow the planks to be removed unless the platform assembly is substantially disassembled. It also reduces the steps required to assemble a secure platform assembly with hold down members thus saving time while still preventing slippage and pilferage. The hold down members have holes at each end, and these holes have a diameter slightly greater than the outer diameter (OD) of the guide pipes at the junctions between vertically extending pipes. As the scaffolding is erected, once the first, lower set of U-shaped supports and overlying planks are set in place, then the hold down members are mounted on the upwardly-extending guide pipes and across the planks. Then, when the next higher set of U-shaped supports is mounted onto the lower set, the hold down members are held in place between the two sets of pipes, and the planks are held in place.

18 Claims, 5 Drawing Sheets

PLANK SECURING SCAFFOLDING ASSEMBLY

FIELD OF THE INVENTION

This invention relates to scaffolding assemblies with plank hold down members that hold planks in place, thus avoiding slippage or pilferage of the planks.

BACKGROUND OF THE INVENTION

Scaffolds are normally built up using a substantial number of inverted U-shaped vertical supports formed of pipes. These inverted U-shaped vertical supports are aligned parallel to one another and extend front-to-rear toward the building; and they have upper horizontal front-to-rear pipes on which planks are placed. Triangular bracing is provided on the U-shaped supports and extending between adjacent supports. A first set of ground layer vertical U-shaped supports is provided, and additional sets of supports are stacked on top of the first set. To align and secure the upper sets of supports to the lower sets, a short guide pipe of reduced diameter is firmly mounted at each pipe junction to extend into each pair of vertically aligned pipes. Further, at each level, the planks are mounted on the horizontally extending front-to-rear extending horizontal pipes associated with each of the U-shaped supports.

These planks, which are usually nominal 2"×12" boards about 12 feet long, are often "borrowed" or stolen by other workmen at the scaffolding location or by others. In addition, when these planks are merely set loosely in place, they may shift in position and fall from the scaffolding, and such an occurrence may result in personal injuries.

SUMMARY OF THE INVENTION

One object of the invention, therefore, is to provide a simple arrangement for holding down scaffolding planks to prevent slippage and pilferage. In accordance with a specific illustrated embodiment of the present invention, this is accomplished by the use of hold down members extending across and in engagement with the planks. These hold down members have holes at each end, and these holes have a diameter slightly greater than the outer diameter (OD) of the guide pipes at the junctions between vertically extending pipes. As the scaffolding is erected, once the first, lower set of U-shaped supports and overlying planks are set in place, then the hold down members are mounted on the upwardly-extending guide pipes and across the planks. Then, when the next higher set of U-shaped supports is mounted onto the lower set, the hold down members are held in place between the two sets of pipes, and the planks are securely held in place. The above described and many other features and attendant advantages of the present invention will become apparent from a consideration of the following detailed description when considered in conjunction with the accompanying drawings.

In accordance with broader aspects of the invention, a platform assembly including supports, a plurality of platforms, and hold down members to hold platforms securely in place may be employed. The vertical supports are formed in sections with joints between successive sections, the hold down members are held securely in place by the upper and lower vertical supports bearing on the upper and lower surfaces of the hold down members at said joints. Clamping hold down members hold down overlapping platforms where vertical support joints with upper and lower supports are not present.

DETAILED DESCRIPTION OF THE PREFERRED EMBODIMENTS

The present invention is directed to scaffolding assemblies with plank hold down members that hold planks in place, thus avoiding slippage or pilferage of the planks. In particular, the present invention allows for a unitary structure of scaffolding assembly with plank hold down members that hold the planks in place. The unitary structure of the scaffolding assembly with hold down members has numerous positive effects. First, it allows for the planks to be held securely in place thus avoiding slippage and potential personal injuries. Second, it acts as a deterrent against pilferage of the planks because the unitary structure of the scaffolding requires that the scaffolding assembly be disassembled in order to remove the planks. As a result, pilferage may occur only if the time has been taken to substantially disassembly the scaffolding assembly, thus creating a deterrent to removing and pilfering the planks. Third, as compared with communicated arrangements previously proposed for the same purpose, the unitary structure reduces the steps required to assemble a secure scaffolding assembly with hold own members thus saving time while still preventing slippage and pilferage.

The following description is provided to enable any person skilled in the art to make and use the invention and to set forth the best modes contemplated by the inventor for carrying out the invention. This description is not to be taken in a limiting sense, but is merely for the purpose of illustrating the general principles of the invention.

Figure 1:
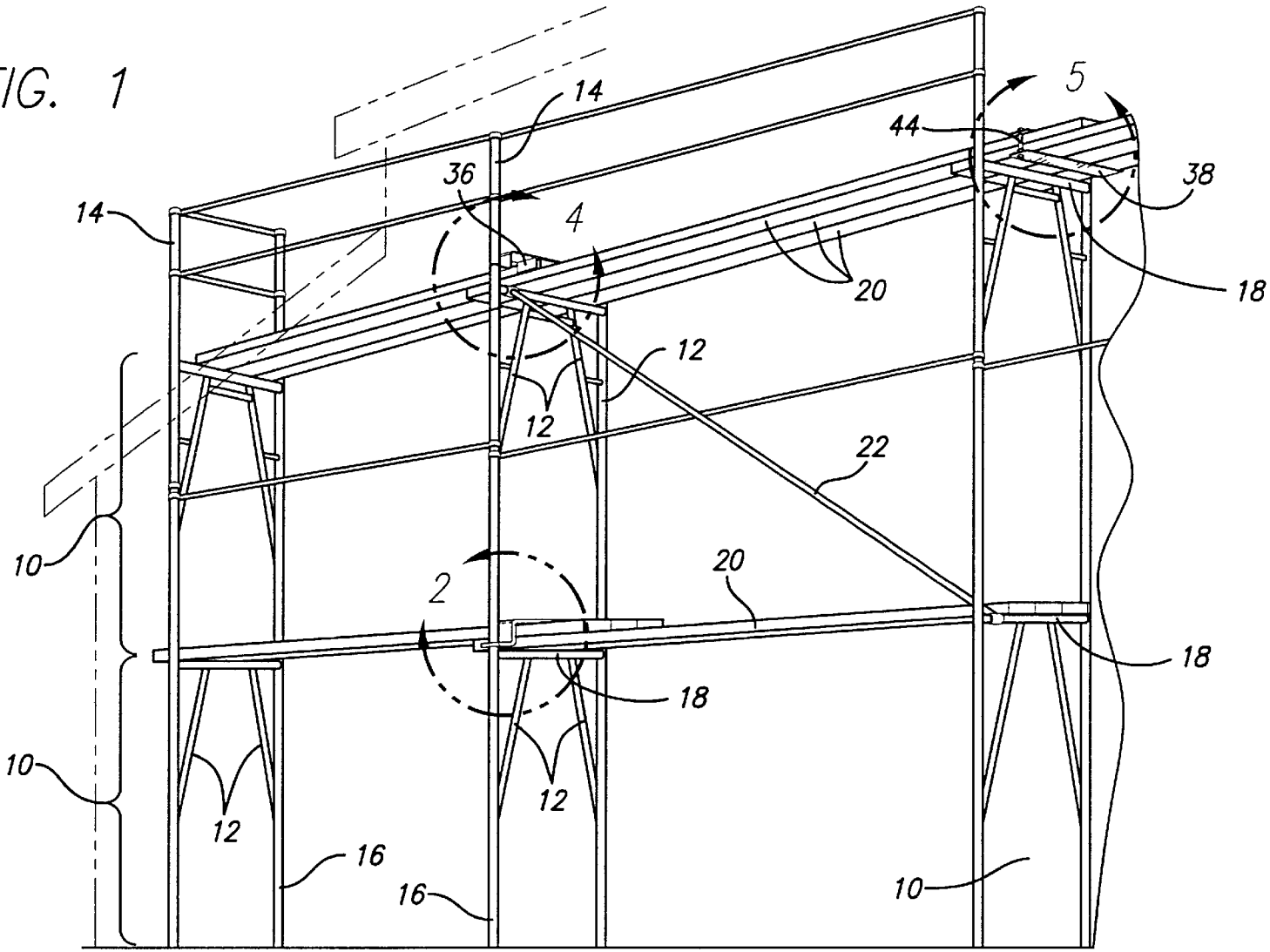
FIG. 1 is a perspective view of a scaffolding system built up using a substantial number of inverted U-shaped supports with triangular bracing and showing support planks and hold down members illustrating the present invention.

By way of example in FIG. 1, the above objects are accomplished by providing a scaffolding system built up using a substantial number of inverted U-shaped supports 10 with triangular bracing 12. In an embodiment of the invention the scaffolding assembly is built up using a set of front vertical pipes 14 and a set of rear vertical pipes 16 where a "set" may include but is not limited to at least two pipes or what is used by one skilled in the art. Although alternative embodiments for the scaffolding assembly use pipes, many various forms of supports, including but not limited to what someone skilled in the art would use, such as supports made of plastic, metal, or wood, for example any combination thereof may be used in the assembly of the scaffolding. In one embodiment the supports are formed of pipes and these pipes may be made of various materials including but not limited to what one skilled in the art would use, for example metal, plastic, wood or any combination thereof. To construct the scaffolding, the inverted U-shaped pipe sections are aligned parallel to one another with upper horizontal front-to-rear pipes 18 on which the planks 20 are placed. Although one alternative embodiment of the invention uses planks, various other materials may be used as the platform in the assembly of the scaffolding. Thus a "platform" may be any material that provides support, including but not limited to what someone skilled in the art would use, such as reinforced plastic, heavy plywood or metallic beams, plastic sheets, and any combination thereof. Also a single "platform" or "plank" may be used instead of multiple "platforms" or "planks". Additional horizontal, vertical and diagonal pipes 22 or other supports may be used to provide extra support for the scaffolding assemblies.

Figure 2:
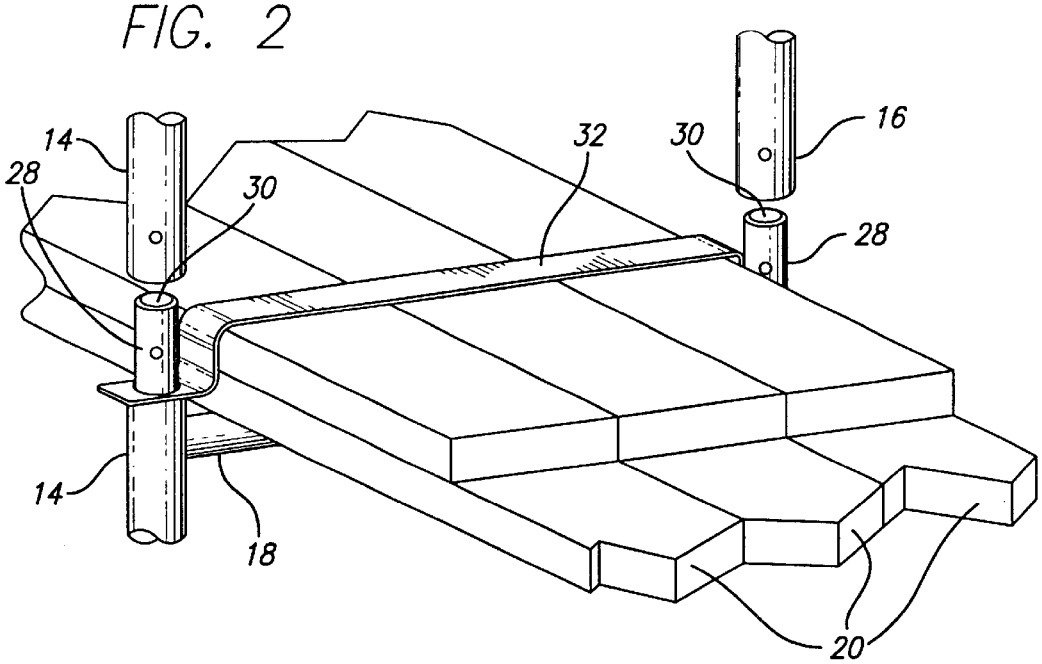
FIG. 2 is a fragmentary perspective view of an illustrative embodiment of a hold down member which is mounted on the upwardly extending guide pipes and secures the planks which are placed on the horizontal front-to-rear pipes and is an enlarged showing of the portion of FIG. 1 identified by the dashed line circle 2.
Figure 4:
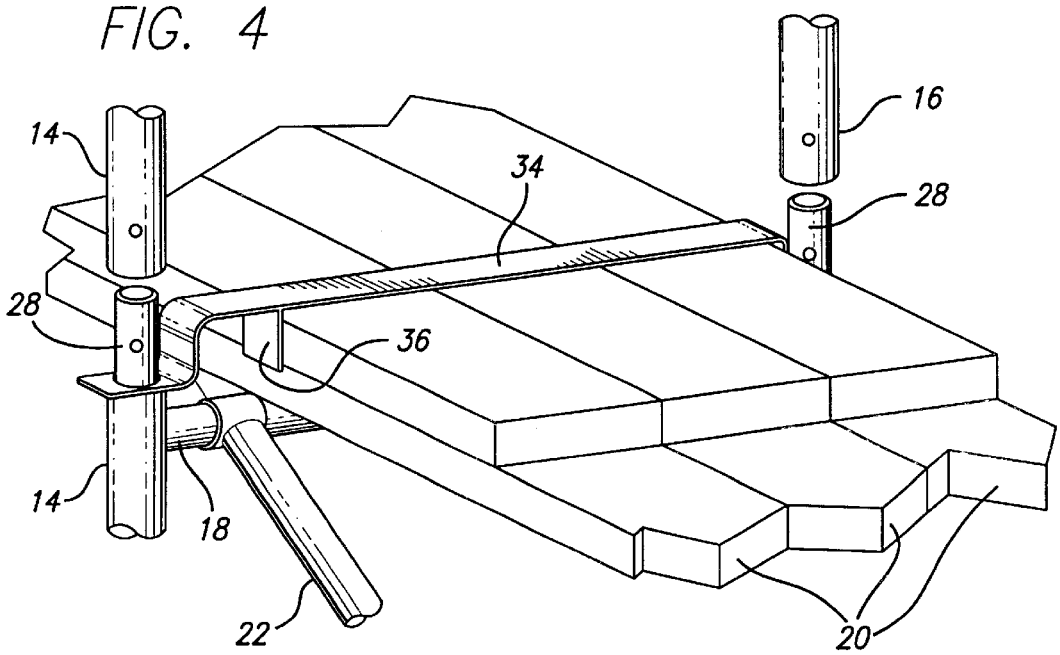
FIG. 4 is fragmentary perspective view of another illustrative embodiment of a hold down member and is an enlarged showing of the portion of FIG. 1 identified by the dashed line circle 4.
Figure 3:
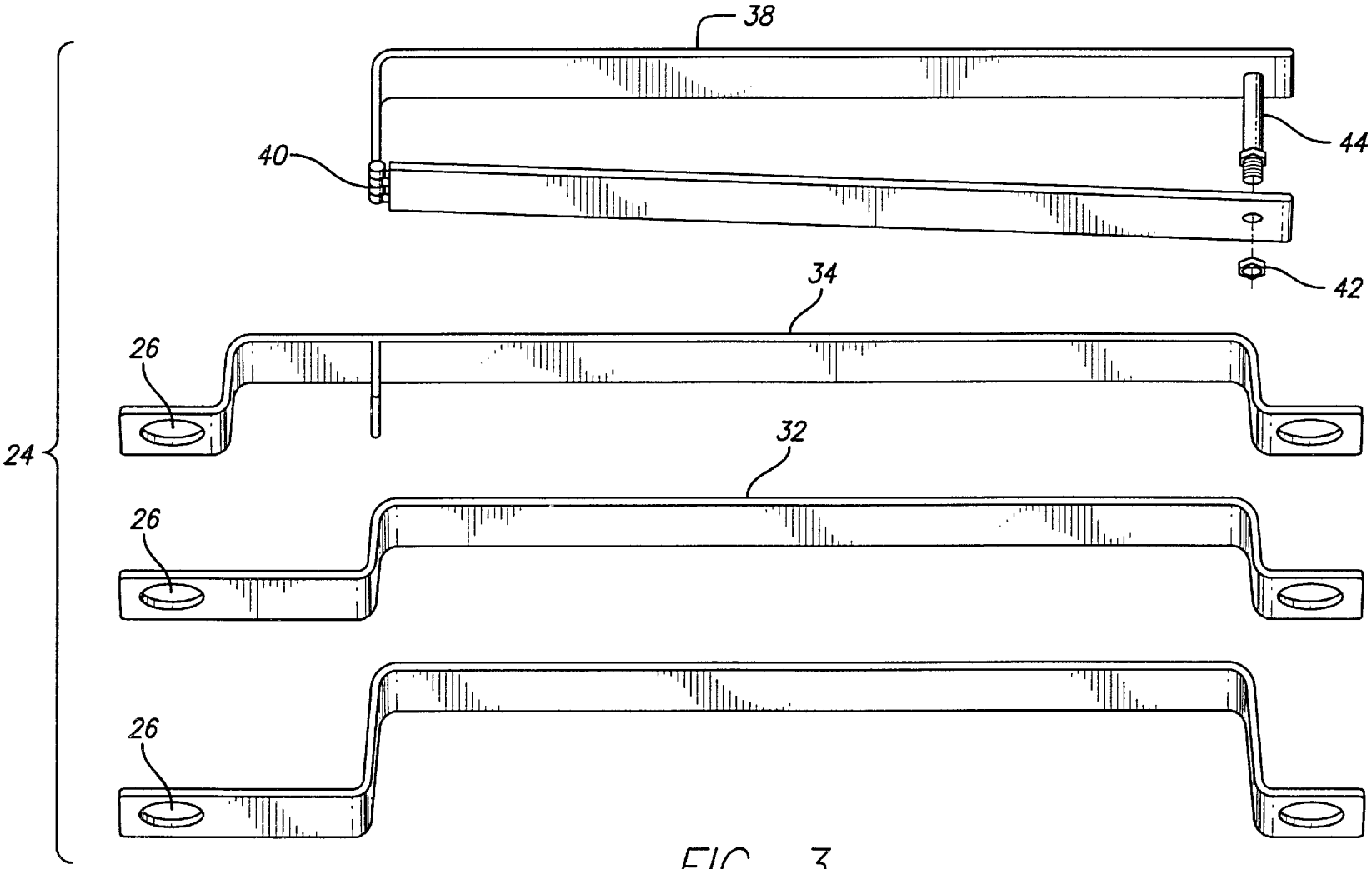
FIG. 3 is a perspective view of different embodiments of the hold down members.
Figure 8:
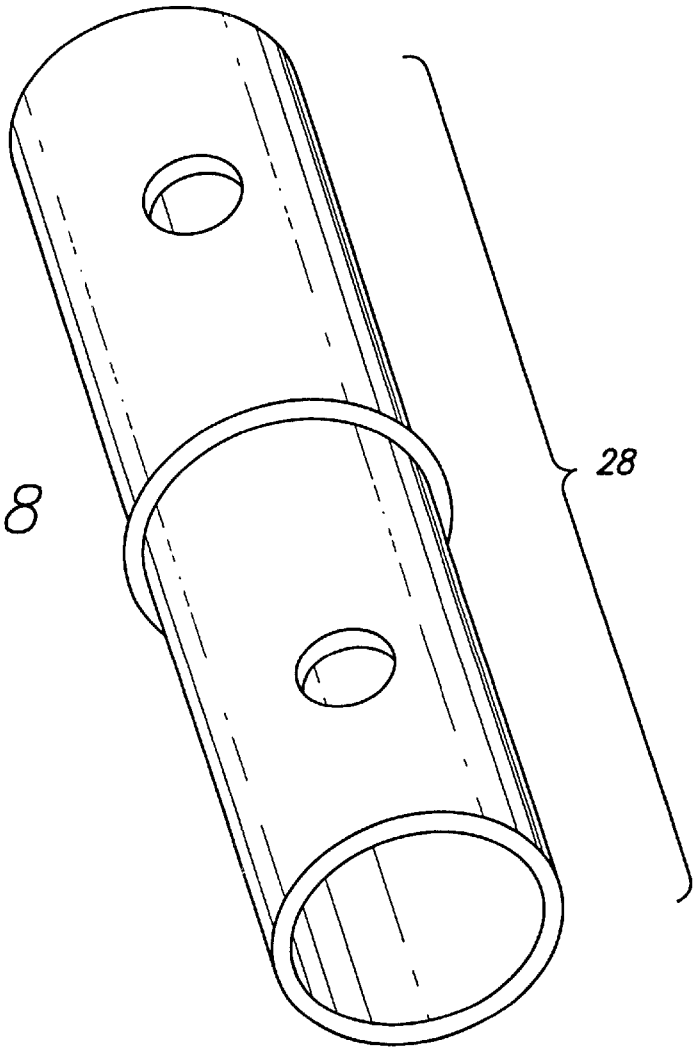
FIG. 8 shows the upwardly extending guide pipe which forms part of the scaffolding system as shown in FIGS. 2 and 4.

As illustrated by way of example in FIGS. 3, illustrative embodiments of the hold down members 24 have holes 26 at each end and these holes 26 have a diameter slightly greater than the outer diameter (OD) of the guide pipe 28 as illustrated in FIG. 8. These guide pipes 28 are used at the junctions 30 between vertically extending pipes 14 and 16 as illustrated in FIGS. 2 and 4. As the scaffolding is erected, once the first, lower set of U-shaped supports 10 and overlying planks 20 are set in place, then the hold down members 24 are mounted on the upwardly-extending guide pipes 28 and across the planks 20. Then, when the next higher set of U-shaped supports 10 is mounted onto the lower set, the hold down members 24 are clamped in place between the two sets of pipes 14 and 16, and the planks 20 are held securely in place.

As illustrated by way of example in FIG. 2, one embodiment of the present invention includes inverted U-shaped hold down members 32 that are mounted on the upwardly extending guide pipes 28 and across planks 20. Then, when the next higher set of U-shaped supports 10 is mounted onto the lower set, the hold down member 32 is clamped in place between the two sets of pipes 14 and 16, and planks 20 are held in place. In this embodiment, the hold down member 32 has an inverted U shape but other shapes may exist, including but not limited to what someone skilled in the art would do and any shape that substantially conforms to the shape of the plank or platform.

As illustrated by way of example in FIG. 4, another embodiment of the present invention includes inverted U shaped hold down members 34 with a platform retaining protrusion 36 which holds the planks 20 in place. The platform retaining protrusion 36 securely holds the planks 20 in place while the inverted U-shaped configuration allows for other triangular bracing supports 22 to attach to the horizontal front-to-rear pipes 18. FIG. 4 demonstrates an embodiment where the support 22 comes from the bottom and attaches to the horizontal front-to-rear pipe 18 but other angles and directions may exist, including but not limited to what angle or direction one skilled in the art would choose, and any angle or partial angle from 0 to 360 degrees and any direction which would allow the support to add stability to the scaffolding assembly.

Figure 5:
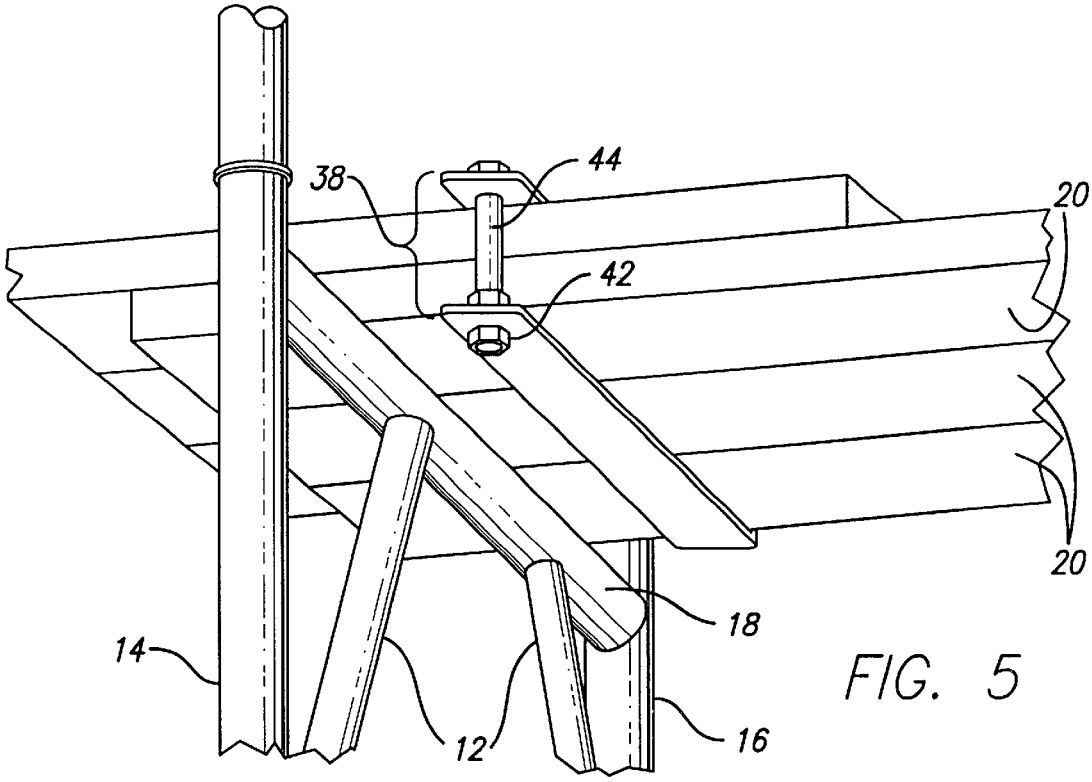
FIG. 5 is a fragmentary side view of another illustrative embodiment of a hold down member wherein the hold down member securely holds down two layers of overlapping planks and is an enlarged showing of the portion of FIG. 1 identified by the dashed line circle 5.

As illustrated by way of example in FIG. 5, another embodiment of the present invention includes a clamping hold down member 38 wherein the hold down member 38 securely holds down two layers of overlapping planks 20. FIG. 5 demonstrates an embodiment where a hinge 40 is used and the clamping hold down member is securely fastened with a nut 42 and bolt 44 but other methods of securing and holding together the clamping hold down member may exist including but not limited to what one skilled in the art would use, such as, a latch, spring, coil, bolt, screw nail, facet, or any combination thereof.

FIG. 3 illustrates the different hold down members 24. FIG. 3 demonstrates the specific lengths and thickness of the hold down members independently and relative to one another but other lengths and thickness may exist, including but not limited to the length and thickness chosen by one skilled in the field.

Figure 6:
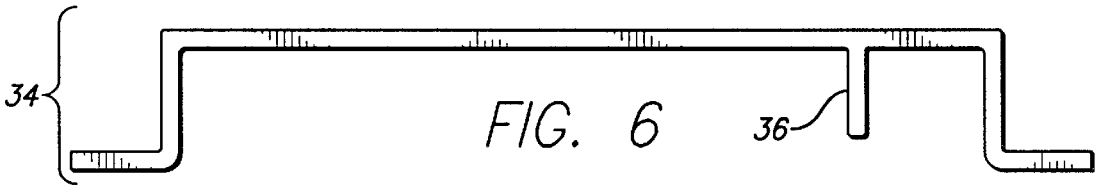
FIG. 6 is side view of an illustrative embodiment of a hold down member which includes a platform retaining protrusion which allows for the planks to remain in place and an inverted U shaped portion that allows for other supports to attach to the horizontal front-to-rear pipes.
Figure 7:
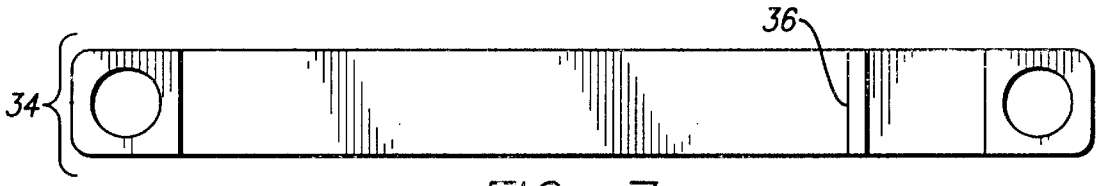
FIG. 7 is a bottom view of FIG. 6.
Figure 9:
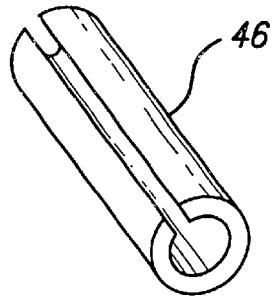
FIG. 9 shows a retaining pin for holding the guide pipe and vertical support pipes in place.

FIG. 6 and FIG. 7 are side and bottom views of the hold down member 34 with platform retaining protrusion 36 illustrated in FIG. 4. FIG. 8 illustrates the guide pipe 28 at the junction 30 between vertically extending pipes 14 and 16. FIG. 8 illustrates the guild pipe 28 with particular, diameter, shape and dimensions but other diameters, shapes and dimensions may exist, including but not limited to the diameter, shape and dimensions chosen by one skilled in the art. FIG. 9 illustrates a retaining pin 46 for holding the guide pipe 28 and vertical support pipes 14 and 16 together. Other diameters, shapes, materials and dimensions may exists for the retaining pin including but not limited to what one skilled in the fields would use. In one embodiment of the present invention, the hold down members have length of approximately 38.5 inches, a height of approximately 2.4 inches and a depth of approximately 2 inches, but other dimensions may exist, including but not limited to a length of approximately 37 inches to 39 inches, a height of approximately 1.25 inches to 3.25 inches and a depth of 1 to 3 inches. A length, width and depth used by one skilled in the art may also be used. In one embodiment of the present invention, the hold down members have holes 26 with a diameter of approximately 1.5 inches and a platform retaining protrusion 36 that is approximately 5.1 inches from the closest part of the hold down member hole 26.

In conclusion, it is to be understood that the foregoing detailed description and accompanying drawings are illustrative of the principals of the invention. In the description of the embodiments, reference is made to the accompanying drawings which form part thereof, and which are shown by way of illustration specific embodiments in which the invention may be practiced. It is not intended to be exhaustive or to limit the invention to the precise form disclosed. It is to be understood that other embodiments may be utilized and structural and functional changes may be made without departing from the scope of the invention. Various changes and modifications may be employed, for example, but not by limitation, different shapes, dimensions and materials of support planks or platforms and scaffolding supports, different angles and arrangements of the scaffolding supports and hold down members and different attachment, clamping and securing mechanisms for the described hold down members, joints between successive sections, and the scaffolding supports may be employed. Likewise, methods other than welding, bolting, clamping and using hinges may be used, such as nails or other known securing mechanism.

Accordingly, the invention is not limited to this detailed description or to the specific embodiments described and shown in the drawings. With respect to the claims, it is the applicant's intention that the claims not be interpreted in accordance with the sixth paragraph of 35 U.S.C. § 112 unless the term "means" is followed by a functional statement.

I claim:

1. A method of securing scaffolding material in place and against theft, comprising the steps of:

erecting a first level of scaffolding including:

(a) a set of front vertical pipes;

(b) a set of rear vertical pipes; said vertical pipes having a predetermined OD and ID;

(c) a set of front-to-rear extending horizontal pipes extending between said front and rear vertical pipes;

(d) a first transverse set of pipes intercoupling said front vertical pipes;

(e) a second transverse set of pipes intercoupling said rear vertical pipes;

(f) a plurality of planks mounted on said set of horizontal pipes;

(g) circular guide coupling members having an OD slightly less than the ID of said vertical pipes, extending into the upper end of said vertical pipes and extending for a short distance above the end of said vertical pipes;

forming a plurality of hold down members formed of material having a substantially constant thickness and width, with downwardly offset ends, said ends having holes there through slightly larger than the OD of said coupling members and less than the OD of said vertical pipes;

placing said hold down members over and in engagement with said planks with the holes at the ends of said hold down members extending around and mating with the upwardly extending coupling members; and erecting a second level of scaffolding above said first level of scaffolding, with the vertical pipes of said second level of scaffolding extending over said coupling members, and bearing down on said ends of said hold down members;

whereby said planks are held in place by said hold down members, and said hold down members provide increased front-to-rear mechanical strength to the scaffolding.

2. A method as defined in claim 1 wherein said hold down members are formed with ah offset substantially equal to the thickness of said planks.

3. A method as defined in claim 1 wherein said hold down members are formed with an offset substantially equal to twice the thickness of said planks.

4. A method as defined in claim 1 wherein at least one of said hold down members is formed with an additional downwardly extending tab which engages one side of one of said planks.

5. A method as defined in claim 1 wherein said hold down members are only held in position by the coupling members and the vertical pipes bearing on the upper and lower surfaces of the coupling members.

6. A method as defined in claim 1 wherein said hold down members are placed over said planks with portions of said planks extending in both directions from said hold down members.

7. A method of securing scaffolding material in place and against theft, comprising the steps of:

erecting a first level of scaffolding including:

(a) a set of front vertical pipes;

(b) a set of rear vertical pipes; said vertical pipes having a predetermined OD and ID;

(c) a plurality of planks mounted on said first level of scaffolding;

(d) guide coupling members having an OD slightly less than the ID of said vertical pipes, extending into the upper end of said vertical pipes and extending for a short distance above the end of said vertical pipes;

forming a plurality of hold down members having a horizontal extent and downwardly offset ends, said ends having holes there through slightly larger than the OD of said coupling members and less than the OD of said vertical pipes;

placing said hold down members over said planks with the holes at the ends of said hold down members extending around with and mating with the upwardly extending coupling members; and erecting a second level of scaffolding above said first level of scaffolding, with the vertical pipes of said second level of scaffolding extending over said coupling members, and bearing down on said ends of said hold down members;

whereby said planks are held in place by said hold down members, and said hold down members provide increased front-to-rear mechanical strength to the scaffolding.

8. A method as defined in claim 7 wherein said hold down members are formed with an offset substantially equal to the thickness of said planks.

9. A method as defined in claim 7 wherein said hold down members are formed with an offset substantially equal to twice the thickness of said planks.

10. A method as defined in claim 7 wherein at least one of said hold down members is formed with an additional downwardly extending tab which engages one side of one of said planks.

11. A method as defined in claim 7 wherein said hold down members are only held in. position by the coupling members and the vertical pipes bearing on the upper and lower surfaces of the coupling members.

12. A method as defined in claim 7 wherein said hold down members are placed over said planks with portions of said planks extending in both directions from said hold down members.

13. A method of securing scaffolding material in place and against theft, comprising the steps of:

erecting a first level of scaffolding including (a) a set of front vertical pipes;

(b) a set of rear vertical pipes; said vertical pipes having a predetermined OD and ID;

(e) a plurality of elongated platform members mounted on said first level of scaffolding;

(f) guide coupling members having an OD slightly less than the ID of said vertical pipes, extending into the upper end of said vertical pipes and extending for a short distance above the end of said vertical pipes;

forming a plurality of hold down members having a horizontal extent and downwardly offset ends, said ends having holes there through slightly larger than the OD of said coupling members and less than the OD of said vertical pipes;

placing said hold down members over said elongated platform members with the holes at the ends of said hold down members extending around with and mating with the upwardly extending coupling members; and erecting a second level of scaffolding above said first level of scaffolding, with the vertical pipes of said second level of scaffolding extending over said coupling members, and bearing down on said ends of said hold down members;

whereby said elongated platform members are held in place by said hold down members, and said hold down members provide increased front-to-rear mechanical strength to the scaffolding.

14. A method as defined in claim 13 wherein said hold down members are formed with an offset substantially equal to the thickness of said platform members.

15. A method as defined in claim 13 wherein said hold down members are formed with an offset substantially equal to twice the thickness of said platform members.

16. A method as defined in claim 13 wherein at least one of said hold down members is formed with an additional downwardly extending tab which engages one side of one of said platform members.

17. A method as defined in claim 13 wherein said hold down members are only held in position by the coupling members and the vertical pipes bearing on the upper and lower surfaces of the coupling members.

18. A method as defined in claim 13 wherein said hold down members are placed over said platforms with portions of said platforms extending in both directions from said hold down members.

* * * * *